US005385315A

United States Patent [19]

Rude et al.

[11] Patent Number: 5,385,315

[45] Date of Patent: Jan. 31, 1995

[54] TAPE-SPOOL RETENTION MEMBER

[75] Inventors: Edward T. Rude, Columbia, Md.; Robert L. Mozdzer, Stamford, Conn.

[73] Assignee: General Clutch Corporation, Stamford, Conn.

[21] Appl. No.: 37,491

[22] Filed: Mar. 26, 1993

[51] Int. Cl.[6] ..... B65H 75/28

[52] U.S. Cl. ..... 242/586; 242/579

[58] Field of Search ..... 242/68.5, 71.8, 74, 242/74.1, 74.2, 579, 586

[56] References Cited

U.S. PATENT DOCUMENTS

| | | | |
|---|---|---|---|
| 3,523,654 | 8/1970 | Zielke | 242/74.1 |
| 3,661,345 | 5/1972 | Ritz, Jr. et al. | 242/74.1 |
| 3,889,894 | 6/1975 | Deguchi | 242/74 |
| 3,944,155 | 3/1976 | Wilczewski et al. | 242/74 |
| 3,973,740 | 8/1976 | Schankler | 242/74 X |
| 4,018,398 | 4/1977 | Louzil | 242/74.1 |
| 4,213,578 | 7/1980 | Katata | 242/74 |
| 4,266,738 | 5/1981 | Nakagawa | 242/71.8 X |
| 4,283,026 | 8/1981 | Werner | 242/74 X |
| 4,901,936 | 2/1990 | Buelens et al. | 242/74.1 |

*Primary Examiner*—Daniel P. Stodola
*Assistant Examiner*—John P. Darling
*Attorney, Agent, or Firm*—Gottlieb, Rackman & Reisman

[57] ABSTRACT

A novel system is provided for attaching tape to a spool. The method employs a one piece molded or diecast part which comprises both the spool and the means of attachment. The spool has a cavity within the circular core. A pin is molded as a part of the spool and is positioned directly before the mouth of the cavity. Tape attachment is achieved by threading.

10 Claims, 3 Drawing Sheets

TAPE-SPOOL RETENTION MEMBER

TAPE-SPOOL RETENTION MEANS

There are many types of tapes, and their uses are numerous. In many, if not most of these applications, the tape must be stored or accumulated from time to time. Perhaps the most common method for storing tape is to wind it onto a spool. Whenever tape is to be wound onto a spool, the problem of the attachment of the tape to the core of the spool arises. Some situations, like the traditional reel for movie film, require a releasable attachment method, while others require an attachment means that is more permanent. Our invention provides a new and novel means for permanently attaching tape to the core of a spool onto which it to be wound. The prior art contains many devices for accomplishing such an attachment. Most of these require a mechanism employing extra parts to attach the tape. In some cases, the attachment achieved by the use of an adhesive which can be difficult control, or an adhesive tape which must be cut and properly positioned, requiring additional mechanism for that purpose. Methods employing additional parts include ones that use clips to hold the tape to the core of the spool. Other methods employ extra mechanism within the core to retain the end of the tape. Extra parts are undesirable, and small core diameters make mechanisms difficult to employ.

SUMMARY OF THE INVENTION

The tape attachment means of our invention requires only a molded or die cast spool, the tape itself, and a simple installation tool. There are no other parts, and the assembly is very quick and easy. The spool of our invention can be injection molded of plastic, or diecast. The spool and a pin which is used to fasten the tape to the core of the spool are formed as one piece. Hereinafter, either of two acceptable methods for forming the spool, molding or diecasting, will be referred to simply as molding. A portion of the molded spool is formed in the shape of a pin which, during tape installation, is broken free and is used to fasten the tape to the core of the spool. The pin is formed in a position parallel to the core of the spool and in line with an opening in the wall of a pocket formed within the core of the spool. Between the pin and the surface of the core, there is a gap of sufficient size to admit the end of the tape. After the tape is inserted into this gap, the pin is broken free from the spool and forced into the pocket in the core of the spool. As the pin enters the pocket, the tape wraps around it, becoming trapped between the pin and the pocket wall. A very simple hand tool is all that is required to accomplish the attachment.

While there are many applications for our invention that will be apparent to those skilled in the art, an important application is the attachment of tapes used to lift Venetian blinds. The spools on which these tapes are wound must be accumulated within the headrail of the blind. For this reason the accumulation means, usually a spool, must be as small as possible while holding the greatest possible length of tape. Since space is at a premium, the tape attachment means must be as compact as possible. Irregularities in the shape of the surface of the core of the spool will cause distortion in the tape as it is wrapped onto the core. such distortion of the tape is undesirable, so it is important that the surface of the core of the spool be as regular as possible. Tape spools used in the headrails of Venetian blinds are often mounted onto the tilt rod which has an irregular cross-sectional shape so that it is capable of transmitting torque to the lift and tilt mechanisms of the blind. The amount of tape that can be stored on a spool depends upon the thickness of the tape and the number of layers of tape that can be wound onto the spool. And, more tape can be stored on a given sized spool if the core shape is round rather than some irregular shape. This is true because the number of layers is limited by the space between the core and the outside diameter of the flanges of the spool, and each turn has the greatest length if it is round. Therefore, the optimum shape for the outside surface of the core of the spool is a circle.

An objective of our invention is to provide a means of attaching tape to the core of a spool which requires no parts other than the molded spool and the tape.

Another objective of our invention is to provide a means of attaching tape to the core of a spool that requires only a simple hand tool.

Another objective of our invention is to provide a means of attaching tape to the core of a spool that provides good tape retention even when the tape has been fully unwound from the spool.

Still a further objective of our invention is to provide a means of attaching tape to the core of a spool that permits the tape to be aligned properly with respect to the core of the spool.

Yet another objective of our invention is to provide a means of attaching tape to a spool having a small core diameter while storing a maximum length of tape.

A further objective of our invention is to provide a means of attaching tape to the core of a spool with a minimum of distortion to the tape.

Another objective of our invention is to provide a highly symmetric spool to which tape can be easily and quickly attached while minimizing distortion during molding.

BRIEF DESCRIPTION OF THE DRAWINGS

Further objects, features and advantages of our invention will become apparent upon consideration of the following detailed description in conjunction with the drawings, in which.

DETAILED DESCRIPTION OF THE DRAWINGS

Figure 1:
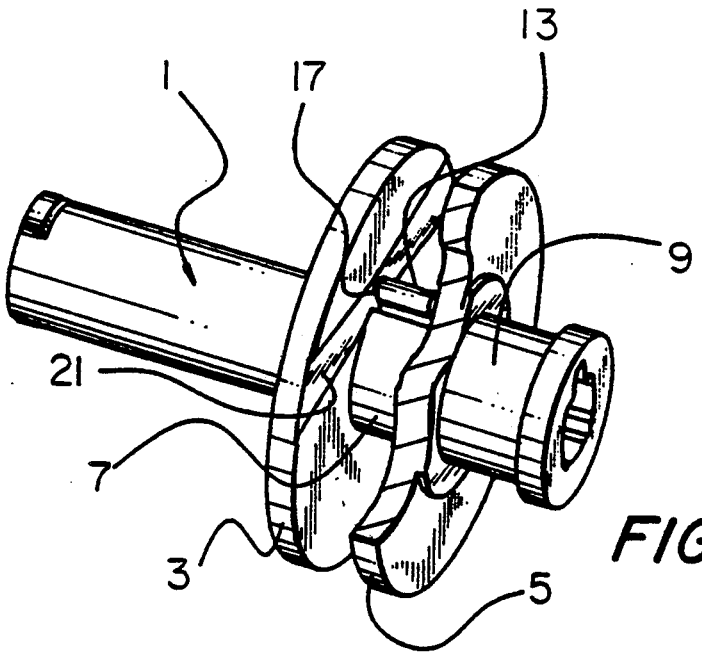
FIG. 1 is an isometric view of the molded spool, with one flange cut away to reveal the pin, prior to the installation of the tape.
Figure 3:
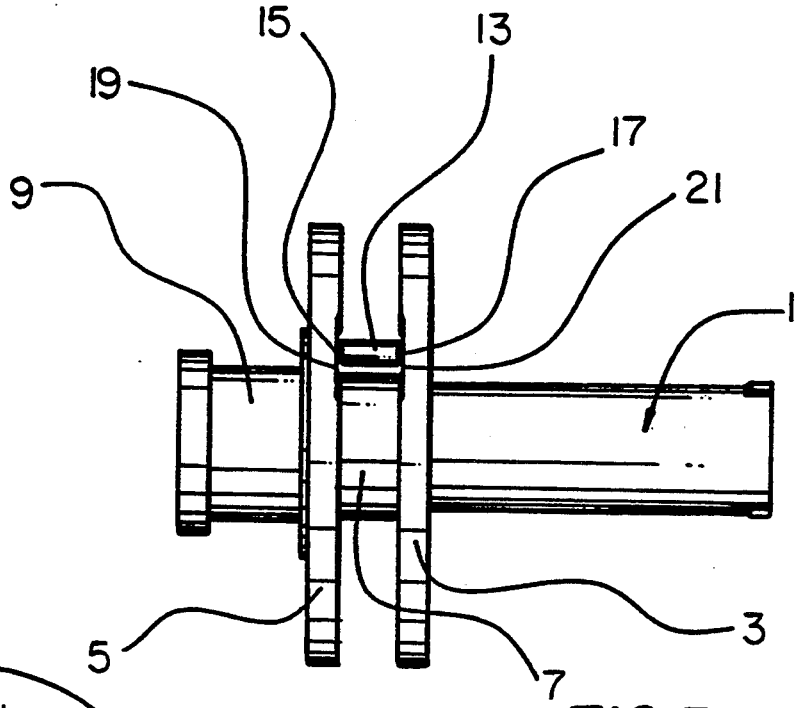
FIG. 3 is a side view of the spool showing the pin in position as molded.
Figure 4:
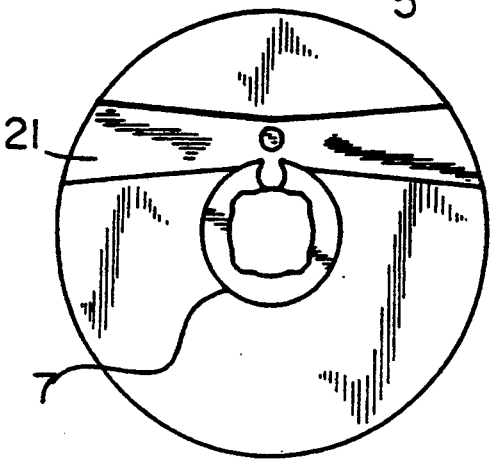
FIG. 4 is an end view of the spool with the pin in position as molded.
Figure 2:
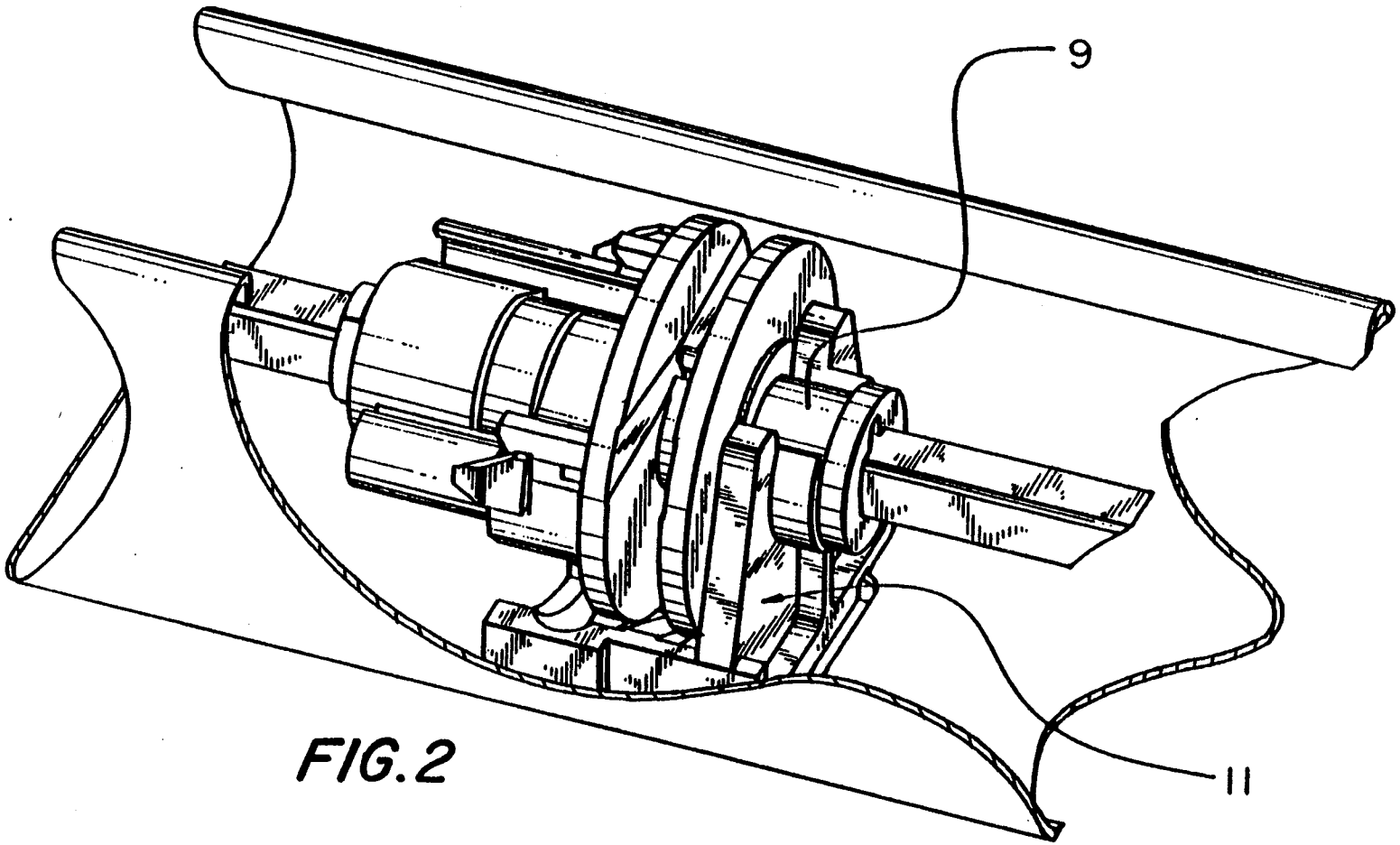
FIG. 2 is an isometric cut-away view of the headrail of a venetian blind showing the spool and its supporting parts.

The configuration of our inventive tape retention spool can best be understood by referring to FIG. 1 which shows the preferred embodiment of spool 1 as it is molded. In common with most spools, spool 1 has flanges 3 and 5, and core 7. The flanges are for guiding tape as it is wound onto core 7, preventing the accumulated tape from "telescoping." Cylindrical journal 9 forms the bearing on which spool 1 is rotatably supported. FIG. 2 shows spool 1 mounted in cradle 11 wherein it is rotatably supported by journal 9. The means of support is of no importance here, and is shown merely as an example. The distinguishing features of the spool of our invention can best be seen by consideration of FIGS. 1, 3, and 4, in each of which, pin 13 is visible. Pin 13 is formed, during molding, as a feature of spool 1. In the process of fastening tape to core 7 of spool 1, pin 13 must be broken free from the flanges 3 and 5. In order to facilitate the breaking free of pin 13, the ends of pin 13, 15 and 17, are reduced in diameter so that there will be less material to fail as it breaks free. This can be most clearly seen in FIG. 3. When pin 13 is broken away from flanges 3 and 5, some of the molded or die-cast material can be expected remain attached to the inside walls of the flanges. Any such material left on the interior walls of flanges 3 and 5 might, if it protruded into the space traversed by the tape as it is wound onto core 7, catch the edges of the tape, causing it to twist or to wind unevenly onto core 7. To prevent this, recesses 19 and as seen in FIG. 3, are formed on the inside surfaces of flanges 3 and 5 so that any material remaining on the flanges after pin 13 is broken away will be below the inside flange surfaces and, therefore, not come into contact with the tape as it is wound onto core 7 of spool 1.

Figure 5:
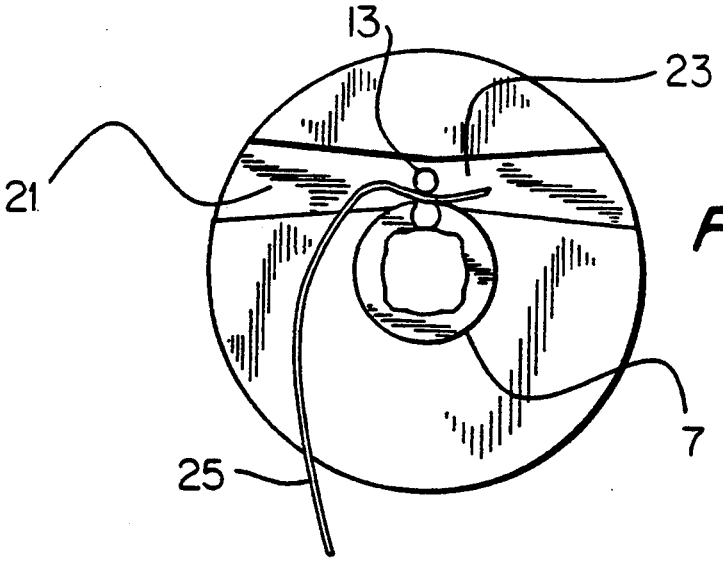
FIG. 5 is the same end view as that of FIG.4 but with the tape inserted through the gap between the pin and the core of the spool.
Figure 6:
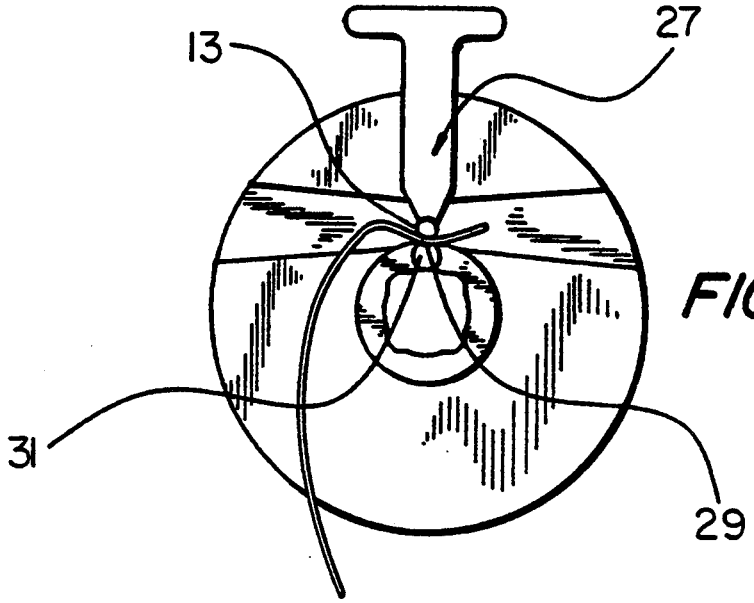
FIG. 6 shows the same end view as in FIGS. 4 and 5, but with the pin broken free with the aid of the tape insertion tool, and moved into the mouth of the pocket in the core of the spool.
Figure 7:
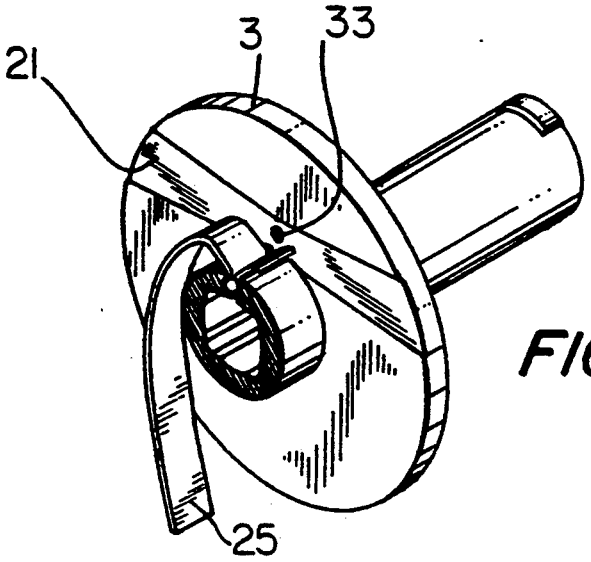
FIG. 7 is an isometric view of the completed assembly but with one flange cut away to show the tape fully installed into the core of the spool.

Tape installation is accomplished by inserting end 23 of tape 25 into the gap between pin 13 and core 7 as seen in FIGS. 5 and 8. Once tape 25 is in place, pin 13 can be broken free. This is done by forcing pin 13 in a radially inward direction. Insertion tool 27 preferably has end having a cylindrical depression therein, however, many other forms of insertion tools can be used successfully. In fact, a small pair of pliers works reasonably well. FIG. 6. shows pin 13, having already been broken free of spool 1, being pushed into mouth 29 of pocket 31. To complete the attachment, it is only necessary to force pin 13, with tape 25 wrapped thereabout, through mouth 29 of pocket 31. Mouth 29 is formed so that it is slightly smaller than the diameter of pin 13 with tape 25 wrapped about it. As pin 13 passed through mouth 29, some flattening of tape 25 will occur, along with some distortion of pin 13 and the walls of mouth 29. The choice of tape material and thickness, together with the characteristics of the spool material, must be taken in consideration when choosing the sizes for mouth 29 and pin 13. FIG. 7 shows the completed assembly. Within recess 21 of flange 3 can be seen broken material 33. This is the irregularly shaped remnant that is left after pin 13 broken free of flange 3. There will be another, similar remnant on the other flange. Recesses 19 and 21 have two purposes. The first of the purposes is to provide a means for forming ends 15 and 17 to a very small diameter so as to make it easier to break pin 13 free from the flanges during tape installation. In order to insure good tape retention, it is desireable that the outside diameter of pin 13 be uniform over essentially the full width of core 7, which is to say essentially the full distance between the inside surfaces of the flanges. Recesses 19 and 21 provide relief for the tool which forms the small ends of the pin. The second purpose of recesses 19 and 21 is to insure that broken material 33 on flange 3, and the corresponding broken material on flange 5, do not extend into the space between flanges so far that the tape hits the ends of the broken material as it is wound onto the core of the spool. The reduced size of the ends of the pin cause the pin material to shear very near the surface of the recesses in the flanges. The recesses must be deep enough so that the space between the flange surfaces is clear.

It will thus be seen that the objects set forth above among those made apparent from the preceding description, are efficiently attained and, since certain changes may be made in the construction of the inventive spring clutch without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

We claim:

1. A tape spool assembly comprising:

a length of tape having a first end;

an integrally molded spool comprising a rotatable core adapted for winding said length of tape thereabout having a surface along which said tape first end is disposed prior to tape winding and means adapted for urging said tape end toward said core surface in order to substantially avoid tape distortion during the winding of said tape; wherein said urging means comprises a pin having first and second ends extending between and connected to a pair of flanges, and located above the surface of said core prior to winding said type for defining a gap therebetween in order to receive said tape end.

2. The assembly of claim 1, wherein said core includes a pocket formed in the surface thereof and adapted to receive said pin when urged toward said core so as to substantially avoid irregularities along said core surface.

3. The assembly of claim 2, wherein said flanges are substantially parallel and transversely disposed with respect to said core for guiding said tape as it is wound about said core.

4. The assembly of claim 3, wherein said pin has a pair of ends of a reduced diameter connecting said pin to said flanges.

5. The assembly of claim 4, wherein said pin ends are selectively disconnectable from said flanges in response to a sufficient force directed inwardly toward said core.

6. The assembly of claim 5, wherein said pin is adapted for reception in said core pocket after disconnection from said flanges in response to said inward force.

7. The assembly of claim 1, wherein each of said flanges includes an inner recess from which the ends of said pin extend.

8. An integrally molded spool assembly for storing tape comprising:

a rotatable core with a surface;

a pair of flanges disposed transversely with respect to said core for guiding said tape as it is would about said core;

a pin with a pair of ends extending between and connected to said flanges at said ends, said pin and said core defining a gap therebetween for receiving the end of said tape prior to winding;

wherein said pin ends are selectively disconnectable from said flanges in response to a sufficient force directed inwardly toward said core in order to enable said pin to urge said tape end toward said core surface and thereby substantially avoid tape distortion during winding.

9. The assembly of claim 8, wherein said core includes a pocket formed in the surface thereof and adapted to receive said pin.

10. The assembly of claim 8, wherein each of said flanges includes an inner recess from which the ends of said pin extend.

* * * * *